US010845090B2

(12) United States Patent
Crowe

(10) Patent No.: US 10,845,090 B2
(45) Date of Patent: Nov. 24, 2020

(54) HEATING SYSTEM FOR ELECTRIC FIREPLACES AND SPACE HEATERS

(71) Applicant: Twin-Star International, Inc., Delray Beach, FL (US)

(72) Inventor: Matthew Crowe, Dongguan (CN)

(73) Assignee: Twin-Star International, Inc., Delray Beach, FL (US)

( * ) Notice: Subject to any disclaimer, the term of this patent is extended or adjusted under 35 U.S.C. 154(b) by 662 days.

(21) Appl. No.: 15/185,619

(22) Filed: Jun. 17, 2016

(65) Prior Publication Data

US 2017/0363320 A1 Dec. 21, 2017

(51) Int. Cl.
*F24H 3/06* (2006.01)
*H05B 3/00* (2006.01)

(52) U.S. Cl.
CPC ..... *F24H 3/062* (2013.01); *H05B 3/008* (2013.01)

(58) Field of Classification Search
CPC ..... F24H 3/062; H05B 3/008; H05B 3/0033; H05B 31/00; H05B 35/00; F24B 1/1808
USPC ..... 392/360, 407, 410–413
See application file for complete search history.

(56) References Cited

U.S. PATENT DOCUMENTS 6,381,407 B2 * 4/2002 Choi ..... F24C 7/065 392/365
8,249,435 B2 * 8/2012 Rookstool ..... F24H 3/0417 392/347
2004/0151484 A1 * 8/2004 Kaplanis ..... F24C 7/043 392/422
2006/0191529 A1 * 8/2006 McDonald ..... F24B 1/1808 126/500
2010/0328955 A1 * 12/2010 Cunningham ..... H01K 1/18 362/293
2014/0161426 A1 6/2014 Crowe
2016/0099141 A1 * 4/2016 Reisman ..... H01J 61/40 313/112
2017/0328575 A1 11/2017 Crowe

* cited by examiner

*Primary Examiner* — Dana Ross
*Assistant Examiner* — James F Sims, III
(74) *Attorney, Agent, or Firm* — McDonald Hopkins LLC

(57) ABSTRACT

A heating system may include at least two different types of heating elements. The heating elements may include at least one infrared heating element and at least one halogen lamp. The heating elements may be positioned within a heating section of a duct through which air flows to be heated by the heating elements, which air flow may be driven by a fan. The heating system may be incorporated into a variety of heating devices, such as electric fireplaces and space heaters.

18 Claims, 7 Drawing Sheets

HEATING SYSTEM FOR ELECTRIC FIREPLACES AND SPACE HEATERS

BACKGROUND OF THE INVENTION

Electric fireplaces, which simulate the look of wood-burning fireplaces, are known. Such electric fireplaces, in addition to simulating the look of wood-burning fireplaces, may also provide heating to an area in the vicinity of the fireplace. For example, such electric fireplaces may include infrared heating elements to supply that heat. Portable electric space heaters are also known. The heat provided by such space heaters may similarly be supplied by infrared heating elements. The present invention includes improvements to the heating components and systems that may be incorporated into such electric fireplaces and space heaters.

BRIEF SUMMARY OF THE INVENTION

One aspect of the present invention provides an electrical heating system. The electrical heating system in accordance with this aspect of the invention preferably includes a duct, at least one infrared heating element, at least one halogen lamp, and a fan. The duct may define a heating section within which the infrared heating elements and halogen lamps are positioned. The fan may be positioned in communication with the duct so as to move air through the heating section from an inlet to an outlet of the heating section.

In accordance with further aspects of the invention, the system may include a single halogen lamp and multiple infrared heating elements. In one arrangement, that single halogen lamp may be positioned closer to the outlet of the heating section than the multiple infrared heating elements. In accordance with other aspects of the invention, the system may include at least one baffle positioned proximate at least one of the infrared heating elements or halogen lamps. For example, the baffle may be positioned proximate one of the halogen lamps, such that the baffle is positioned between that halogen lamp and the outlet of the heating section. In accordance with yet further aspects of the invention, the fan may be a crossflow fan. According to other aspects of the invention, the infrared heating element may include a filament positioned within an unsealed glass envelope. On the other hand, the halogen lamp may include a filament positioned within a sealed glass envelope containing a halogen gas. According to yet further aspects of the invention, the electrical heating system may include a housing surrounding the duct and including an air outlet adapted to permit heated air to pass therethrough. The system may further comprise a firebox arranged within the housing, which firebox may include at least one artificial log. Further, the log may be visible from outside the housing through at least one opening in the housing.

Another aspect of the present invention provides an electrical heating system. The electrical heating system in accordance with this aspect of the invention preferably includes a housing, at least one infrared heating element, and at least one halogen lamp. The infrared heating elements and halogen lamps are preferably arranged within the housing so as to heat air passing through an air outlet of the housing.

In accordance with further aspects of the invention, the system may include a duct arranged within the housing to supply air to the air outlet, the infrared heating elements and halogen lamps being positioned within the duct. In accordance with another aspect of the invention, the system may include a fan arranged within the housing to drive air through the air outlet. In accordance with yet further aspects of the invention, the system may include a single halogen lamp and multiple infrared heating elements. In accordance with other aspects of the invention, the system may include at least one baffle positioned proximate at least one of the infrared heating elements or halogen lamps. According to other aspects of the invention, the infrared heating element may include a filament positioned within an unsealed glass envelope. On the other hand, the halogen lamp may include a filament positioned within a sealed glass envelope containing a halogen gas. According to yet further aspects of the invention, the electrical heating system may further comprise a firebox arranged within the housing, which firebox may include at least one artificial log. Further, the log may be visible from outside the housing through at least one opening in the housing.

Another aspect of the present invention provides a method of assembling an electrical heating system. The method in accordance with this aspect of the invention preferably includes positioning at least one infrared heating element within a heating section of a duct between an inlet and an outlet of the heating section; positioning at least one halogen lamp within the heating section between the inlet and the outlet; and providing a fan in communication with the duct, such that the fan is adapted to move air through the heating section from the inlet to the outlet.

In accordance with further aspects of the invention, the step of positioning the at least one infrared heating element may comprise positioning a plurality of infrared heating elements within the heating section of the duct, and the step of positioning the at least one halogen lamp may comprise positioning a single halogen lamp within the heating section. In one exemplary aspect, the step of positioning the single halogen lamp may comprise positioning the halogen lamp closer to the outlet than the plurality of heating elements. In accordance with other aspects of the invention, the method may further comprise positioning at least one baffle proximate the at least one infrared heating element or the at least one halogen lamp. In an exemplary aspect, the step of positioning the at least one baffle may comprise positioning a first baffle proximate one of the at least one infrared heating element and positioning a second baffle proximate one of the at least one halogen lamp. In another exemplary aspect, the step of positioning the at least one baffle may comprise positioning the baffle between the at least one halogen lamp and the outlet of the heating section. According to yet further aspects of the invention, the method may further comprise positioning the duct, the infrared heating elements, the halogen lamps, and the fan within a housing of a space heater, such that heated air passed through the heating section of the duct exits the housing through an air outlet. According to another aspect of the invention, the method may further comprise positioning the duct, the infrared heating elements, the halogen lamps, and the fan within a housing of an electric fireplace having a firebox containing at least one artificial log, such that heated air passed through the heating section of the duct exits the housing through an air outlet.

DETAILED DESCRIPTION

Figure 1:
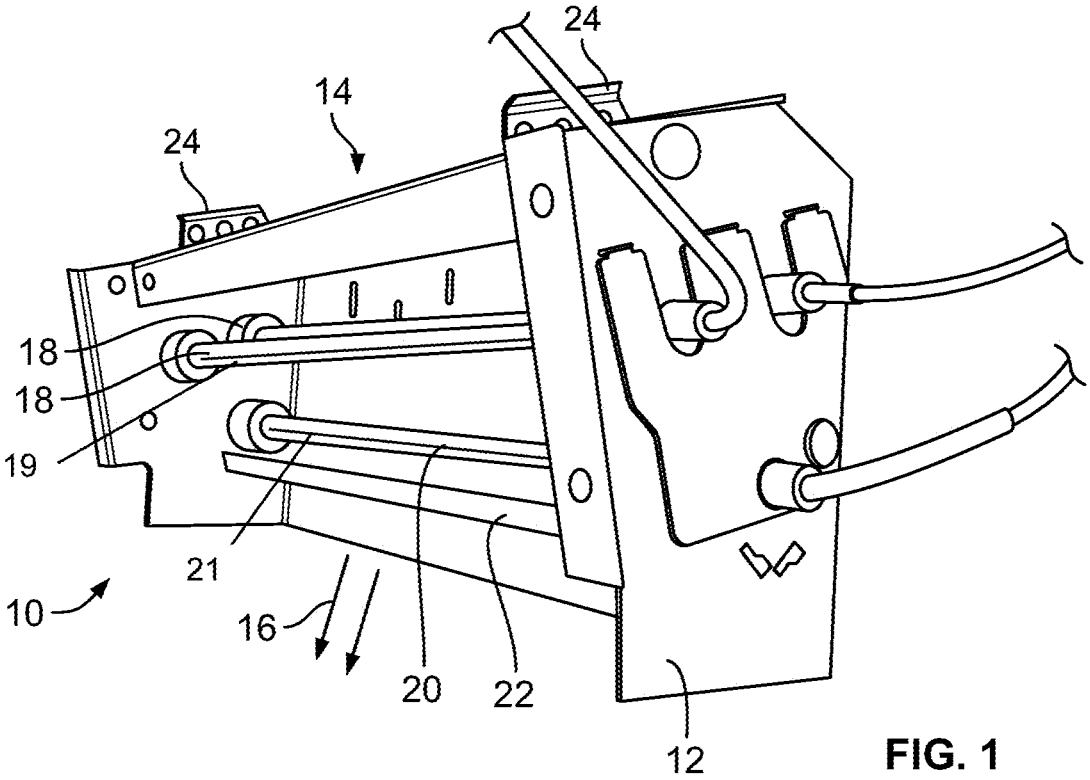
FIG. 1 is a perspective view of a heating section of a heating system in accordance with one embodiment of the present invention.

FIG. 1 illustrates a heating section 10 of a heating system 1 in accordance with one embodiment of the present invention. The heating section 10 may be all or a portion of a duct 12 that defines a space for air to flow through the heating section. The heating section 10 may include an inlet 14 for air to enter the heating section and an outlet 16 for air to exit the heating section. Between the inlet 14 and outlet 16, a plurality of heating elements may be provided, which heating elements may directly and/or indirectly supply heat to the air flowing through the heating section 10. That is, the air flowing through the heating section 10 may heat up by making direct contact with the heated heating elements, and/or the heating elements may heat up surrounding components within the heating section, which heated surrounding components then heat the air as the air contacts them while flowing through the heating section 10.

The heating elements may include at least two different types of heating elements. For example, the heating elements may include at least one infrared heating element 18 and at least one halogen lamp 20. In the embodiment of FIG. 1, two infrared heating elements 18 may be provided, and one halogen lamp 20 may be provided. Moreover, in that embodiment, the halogen lamp 20 may be positioned closer to the outlet 16 than the infrared heating elements 18. In other embodiments, however, any number of halogen and infrared heating elements may be provided, and they can be provided in any arrangement within the heating section 10.

At least one heat exchanger or baffle 22 may also be provided in the heating section 10. Such baffle(s) 22 may have the same structure as any of the heat exchangers disclosed in U.S. Patent Application Publication No. 2014/0161426 (hereinafter "the '426 Publication"), the entire disclosure of which is hereby incorporated by reference herein as if fully set forth herein, and such baffles 22 may be positioned with respect to the heating elements of the heating section 10 in any of the arrangements disclosed in the '426 Publication. Such baffles 22 may serve to interact with the air flowing through the heating section 10, so as to create a desired air flow pattern, and the baffles 22 may also provide heat to the flowing air. For example, the baffles 22, which may be constructed from steel, may absorb radiant energy from the adjacent heating elements, such that the baffles 22 heat up and then transfer some of that heat energy to the air flowing past them. As shown in FIG. 1, at least one baffle 22 may be positioned between one of the heating elements (e.g., the halogen lamp 20) and the outlet 16 of the heating section, which may desirably block at least some of the infrared energy and/or visible light emitted by the associated heating element from directly exiting through the outlet 16 and out of the heating device containing the heating system 1.

As shown in FIG. 1, each of the heating elements may be a linear heating element mounted to opposite sides of the duct 12, such that the heating elements extend across the open space defined by the duct 12 transverse to the direction of the air flow through the duct. The infrared heating elements 18 preferably include an envelope and/or filament 19 (and/or envelope) constructed from a material such that it emits primarily infrared energy when electricity is passed through it. An exemplary filament may be constructed from nichrome (NiCr), although other materials may be used (e.g., other nickel alloys, iron alloys, aluminum alloys, tungsten, carbon, etc.). The filament 19 may be surrounded by a linear glass (e.g., quartz) tubular envelope, which may protect the filament, such as by preventing the flowing air from directly contacting it, and the envelope may also provide structural support to the filament 19 over its length. The envelope need not be sealed, particularly if the filament 19 is constructed from nichrome. The halogen lamp 20, on the other hand, includes a glass (e.g., quartz) tubular envelope that is sealed, such that a halogen gas (e.g., iodine or bromine) is encapsulated within the envelope, as is known in the field of illumination using halogen lamps. In that way, during operation of the halogen lamp 20, the tungsten filament such that envelope and filament 21 of the lamp 20 can be regenerated via the resulting, well-known halogen cycle.

Among the benefits of including both an infrared heating element 18 and a halogen lamp 20 within the heating section 10 is that it desirably provides for a broader spectrum of heating and also a faster heat-up time than just providing infrared heating elements alone. That is, halogen lamps generally heat up more quickly than infrared heating elements, and therefore, when the heating device containing the heating system 1 is first turned on, the halogen lamps desirably provide some rapid heating to a user located close to the heating device. The halogen lamps 20 also are believed to provide more direct, felt heat by the user, whereas the slower infrared heating elements 18 are believed to provide more distributed heat to a larger area surrounding the heating device. Moreover, although halogen lamps also emit infrared radiation, they emit more light in the visible spectrum than infrared heating elements. Therefore, the quickly-provided, visible light emitted by the halogen lamp 20 desirably provides the user with visual reinforcement of the additional felt heat provided by the heating system 1.

The heating system 1 may include a fan positioned in communication with the duct 12 to drive the airflow through the heating section 10. For example, the fan may be positioned proximate to the inlet 14, such as by securing the fan unit to attachment elements (e.g., brackets 24 connected to the duct 12 and positioned adjacent to the inlet 14). A preferred fan may be a crossflow fan 26, having an impeller 28 with forward curved blades positioned at least partially within an enclosure 30, as shown in FIGS. 2-9B. In alternative embodiments in accordance with the present invention, however, other types of fans may be used, such as axial-flow, centrifugal, coanda, convective, electrostatic, etc. The duct 10 may extend upstream and/or downstream of the heating section 10. In one embodiment, the fan enclosure 30 may be defined by a portion of the duct 12, such as a portion of the duct 12 upstream of the inlet 14 of the heating section 10.

Figure 2:
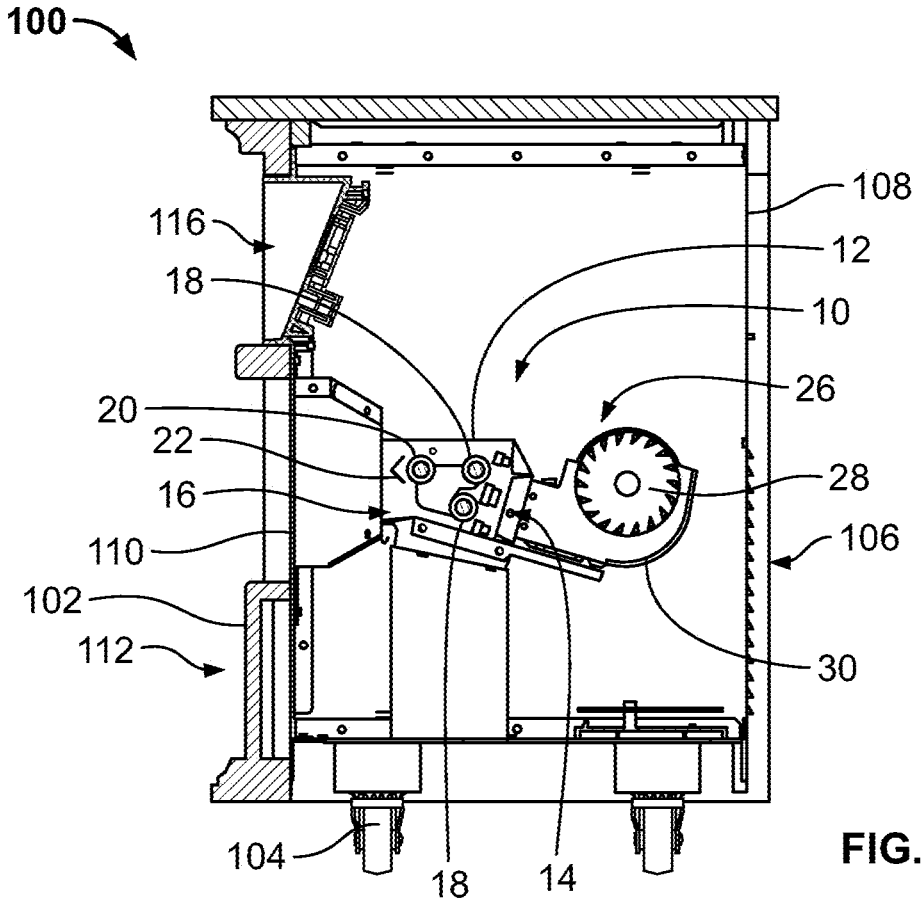
FIG. 2 is a cross-sectional side elevation view of an electric heater incorporating the heating system of FIG. 1.
Figure 3A:
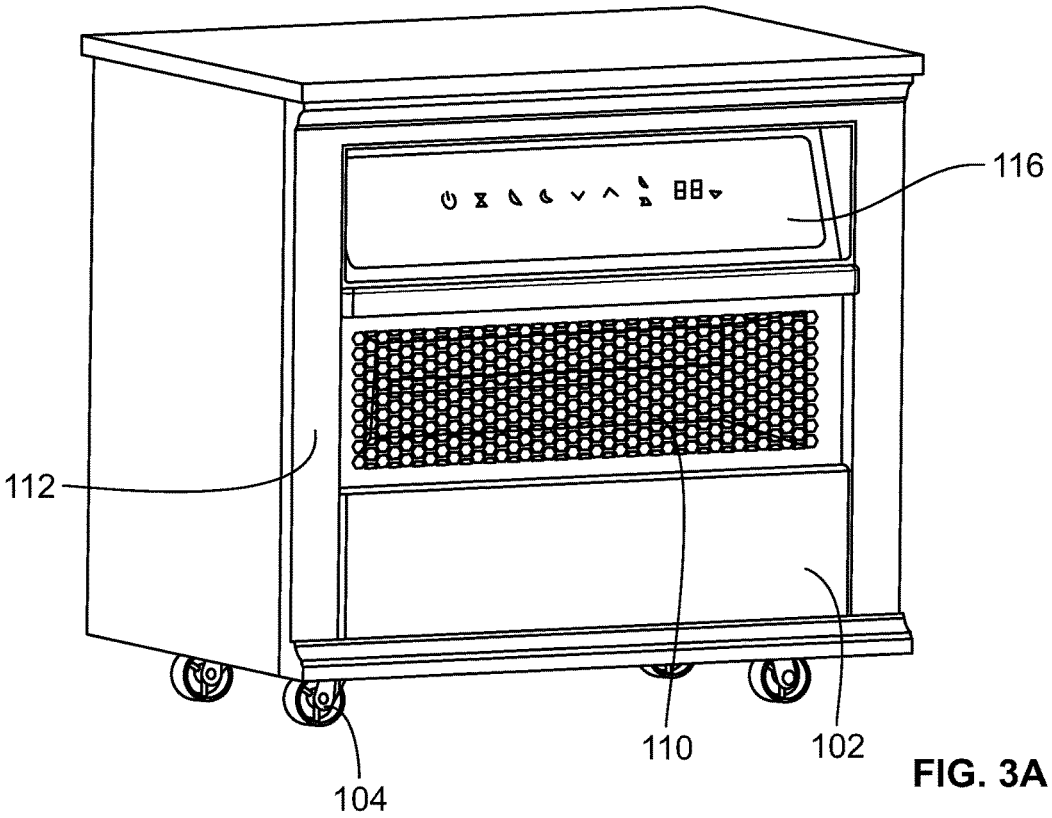
FIG. 3A is a front perspective view of the heater of FIG. 2.
Figure 3B:
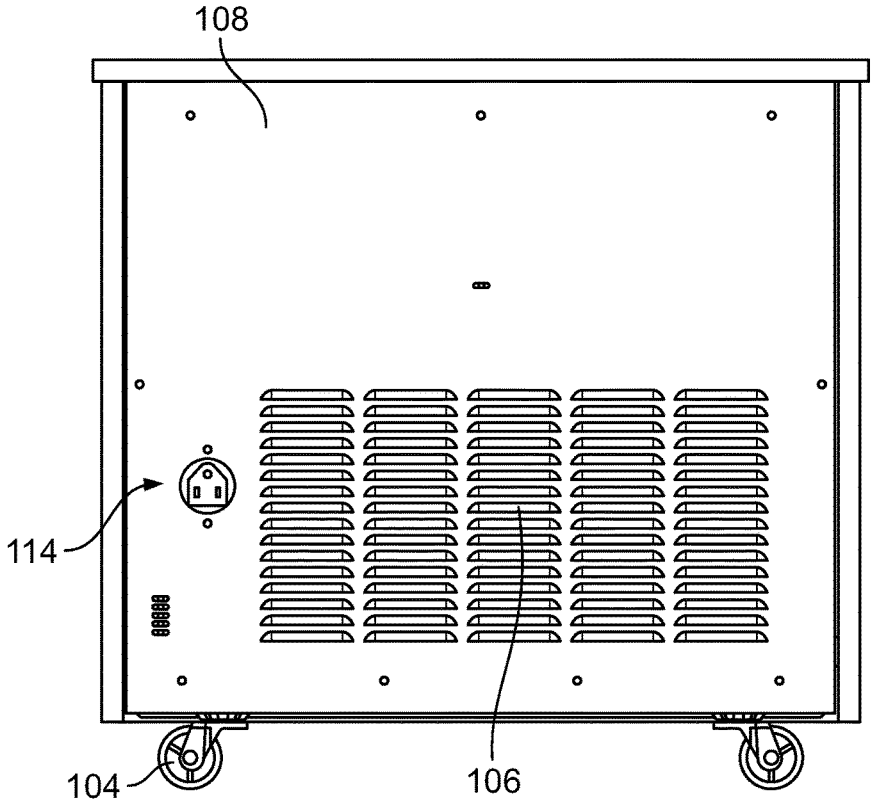
FIG. 3B is a rear elevation view of the heater of FIG. 2.

The heating system 1 discussed above may be incorporated into a variety of heating devices. For example, as shown in FIGS. 2-3B, the heating system 1 may be incorporated into a portable heater 100. The portable heater 100 may include an outer housing 102, which may be in the form of a cabinet containing the other components of the heater 100. The cabinet may be constructed of wood (or a material resembling wood), for decorative effect, although many other suitable materials may be used as well. Casters 104 may be provided at the bottom of the housing 102 to provide at least some of the portability of the heater 100.

As shown in FIG. 2, the heating system 1 may be positioned within the housing 102 such that air from an air intake (which may include a grill 106 on the back 108 of the housing 102) may be pulled through the fan 26 by rotation of the impeller 28, with that air passing through the fan enclosure 30 and then through the heating section 10 before exiting the heater 100 via the air outlet (which may include a grill 110 on the front 112 of the housing 102). The heater 100 may include a plug 114 to provide electrical power to the heater, such as by connecting it to an ordinary electrical socket. The heater 100 may also include a control panel 116 on the front 112 of the housing 102, in order to control various aspects of the heating system. For example, the control panel 116 may allow the user to control the fan speed or the amount of heat provided by the heating elements. The heat provided by the heating elements may be controlled by varying the power supplied to the heating elements, or by selectively turning on and off any one of heating elements. In one example, the user may be given the option of selectively turning on and off the halogen lamp(s) 20 while leaving at least one of the infrared heating elements 18 on.

Figure 4:
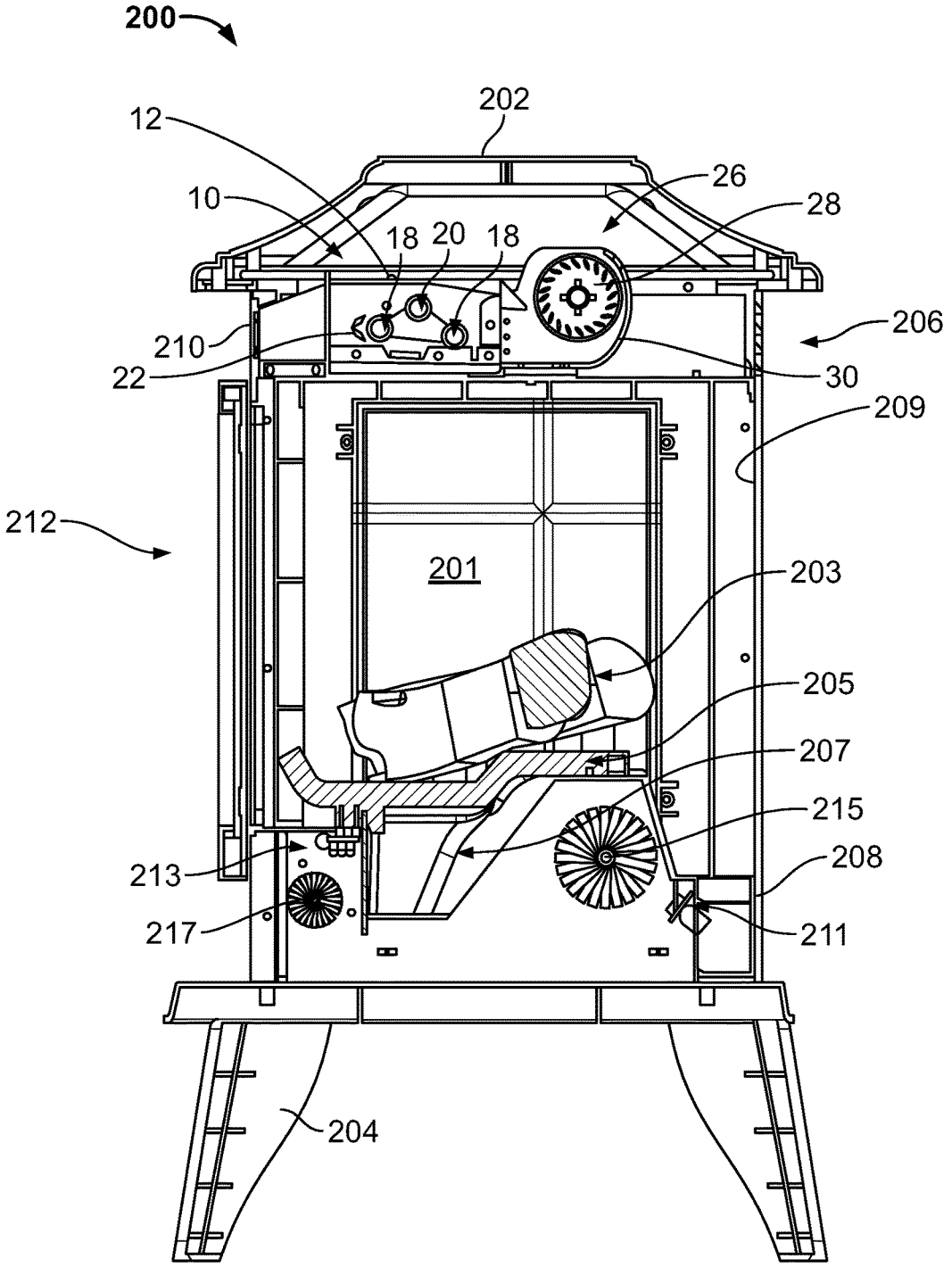
FIG. 4 is a cross-sectional side elevation view of an electric fireplace stove incorporating a heating system similar to that of FIG. 1.
Figure 5C:
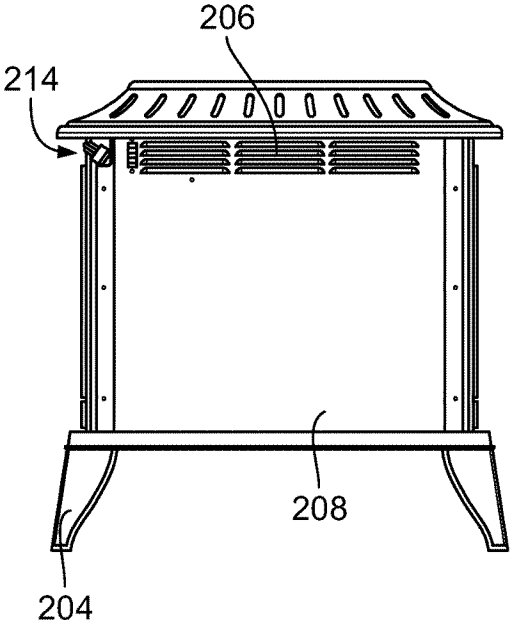
FIG. 5C is a rear elevation view of the fireplace stove of FIG. 4.
Figure 5B:
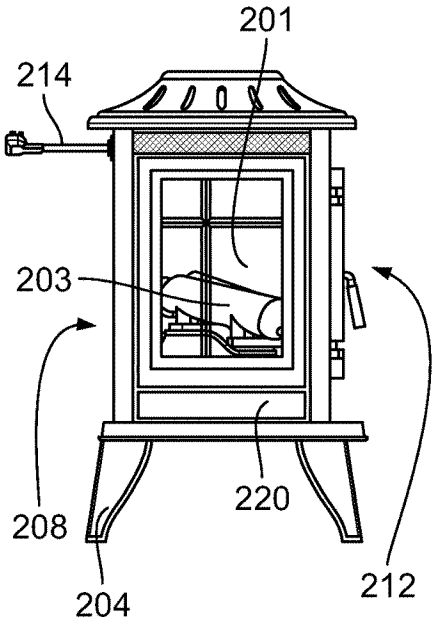
FIG. 5B is a side elevation view of the fireplace stove of FIG. 4.
Figure 5A:
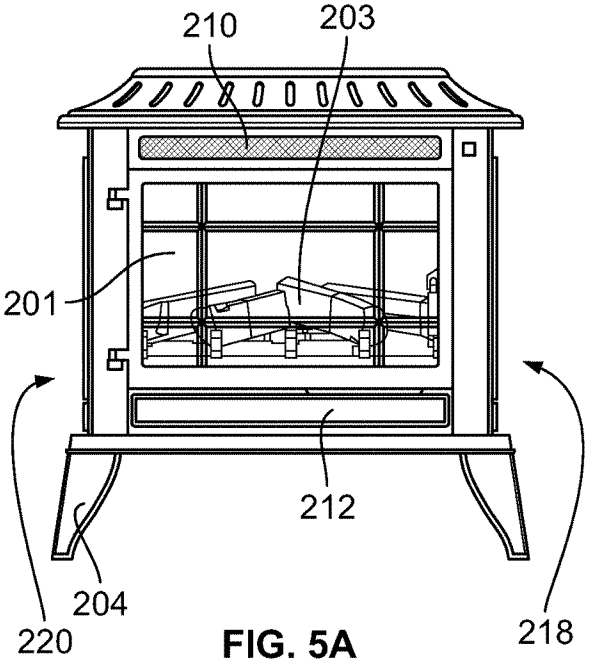
FIG. 5A is a front elevation view of the fireplace stove of FIG. 4.

FIGS. 4-5C illustrate another embodiment of a heating device that may incorporate the heating system 1. In this embodiment, the heating system 1 is incorporated into an electric fireplace stove 200. The electric fireplace stove 200 may include an outer housing 202 having at least one window 201 so as to display one or more logs 203 positioned on a grate 205 in the interior of the housing 202. The logs 203 are preferably artificial, although they may be real wood logs, and the logs 203 may be structured so as to mimic real wood logs. An artificial ember bed 207 may be positioned below the grate 205. In order to simulate the look of a burning fire, any or all of the logs 203, the ember bed 207, or a projection screen 209 defined along the inside of the back 208 of the housing 202 may be illuminated by light sources 211, 213 reflecting off of respective rotatable spinners 215, 217, as disclosed in U.S. patent application Ser. No. 15/155,316, filed on May 16, 2016 and entitled "Electric Fireplace Lighting System" (hereinafter "the '316 application"), the entire disclosure of which is hereby incorporated by reference herein as if fully set forth herein. The electric fireplace stove 200 may be a freestanding unit, with feet 204 being provided to support the housing 202. Moreover, as shown in FIGS. 5A-B, windows 201 may be provided on the front 212 as well as both the right side 218 and the left side 220 of the stove 200, to permit a view of the logs 203 from multiple sides of the stove 200. The heater 200 may also include a plug 214 to provide electrical power to the heater.

As shown in FIG. 4A, the heating system 1 may be positioned within the housing 202 such that air from an air intake (which may include a grill 206 along the back 208 of the housing 202) may be pulled through the fan 26 by rotation of the impeller 28, with that air passing through the fan enclosure 30 and then through the heating section 10 before exiting the fireplace stove 200 via the air outlet (which may include a grill 210 on the front 212 of the housing 202). As also shown in FIG. 4A, the halogen lamp 20 may be positioned in a different arrangement with respect to the infrared heating elements 18 than in the embodiments discussed above.

Figure 6:
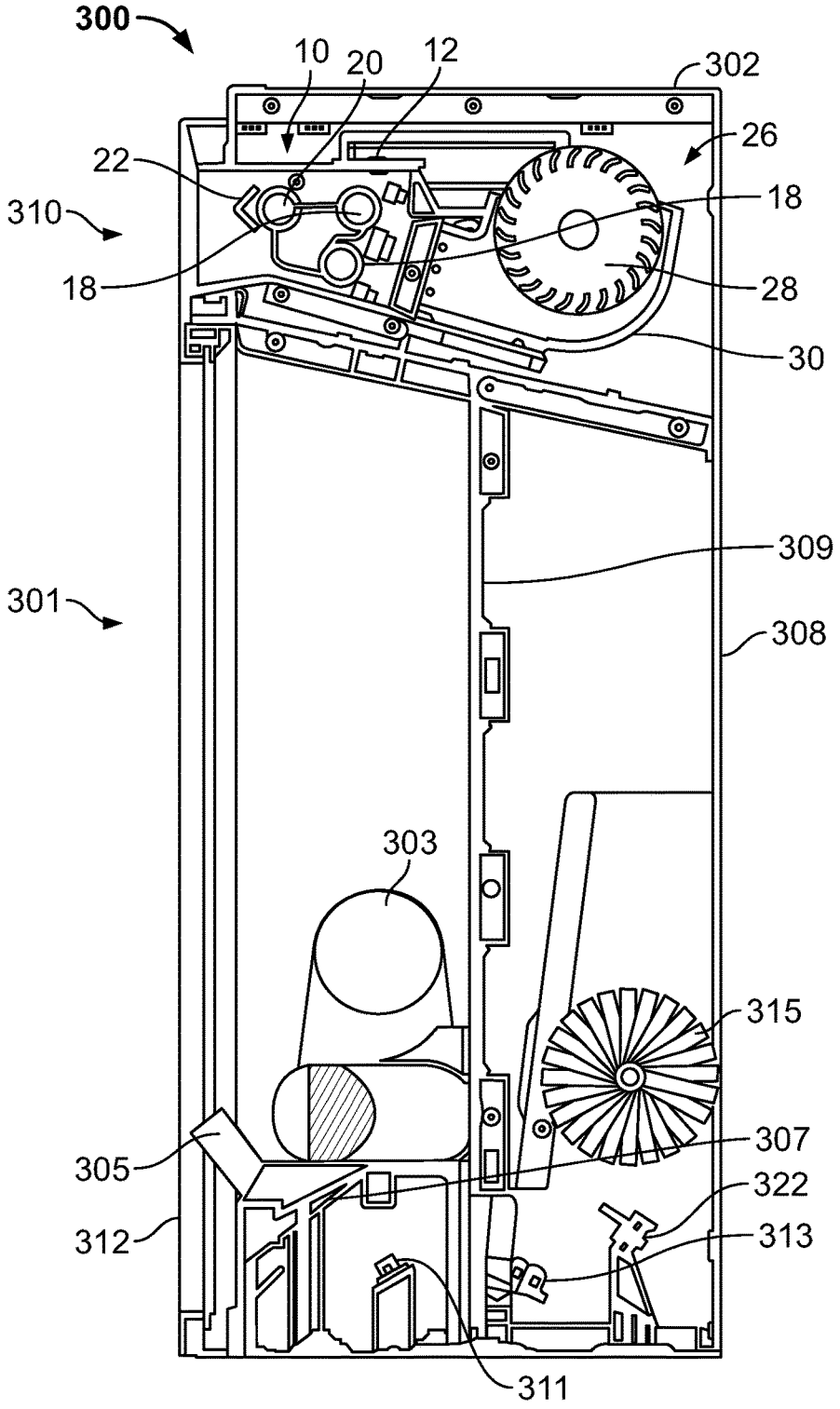
FIG. 6 is a cross-sectional side elevation view of an electric fireplace incorporating the heating system of FIG. 1.
Figure 7B:
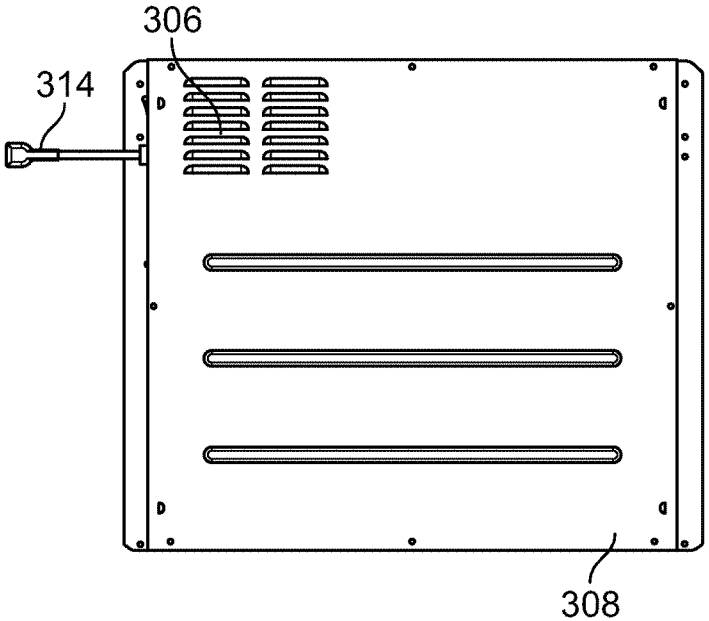
FIG. 7B is a rear elevation view of the fireplace of FIG. 6.
Figure 7A:
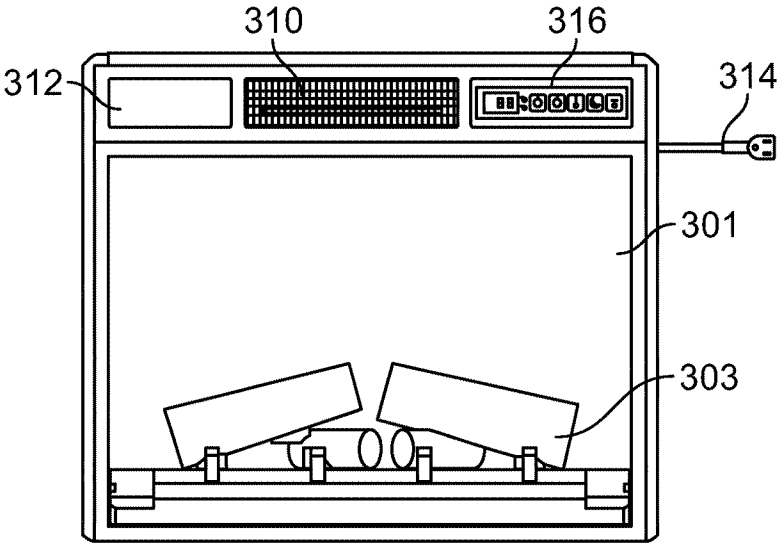
FIG. 7A is a front elevation view of the fireplace of FIG. 6.
Figure 7C:
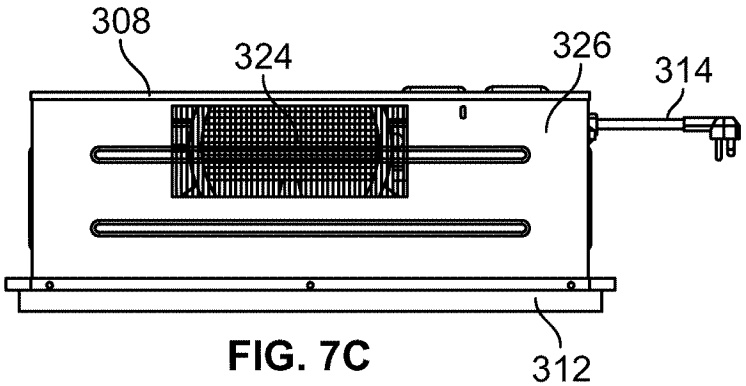
FIG. 7C is a top plan view of the fireplace of FIG. 6.

Yet another embodiment of a heating device that may incorporate the heating system 1 is illustrated in FIGS. 6-7C. In that embodiment, the heating system 1 is incorporated into an electric fireplace 300, which may be a freestanding component or it may be an insert configured to be received within another structure, such as a piece of furniture (e.g., a piece of cabinetry) or an opening in a wall of a building, or even within the firebox of a traditional fireplace. The electric fireplace 300 may include an outer housing 302 having a window 301 so as to display one or more logs 303 positioned on a grate 305 in the interior of the housing 302. The logs 303 are preferably artificial, although they may be real wood logs, and the logs 303 may be structured so as to mimic real wood logs. An artificial ember bed 307 may be positioned below the grate 305. In order to simulate the look of a burning fire, any or all of the logs 303, the ember bed 307, or a rear projection screen 309 defined between the logs 303 and the back 308 of the housing 302 may be illuminated with flickering and/or moving light. For example, the ember bed 307 may be illuminated by a front light source 311, and the rear projection screen 309 may have moving, flame-shaped light projected onto it due to light emitted from a rear light source 313 and reflected off of a rotatable spinner 315. An additional light source 322 may also project light within the area behind the screen 309.

As shown in FIG. 6, the heating system 1 may be positioned within the housing 302 such that air from an air intake (which may include a grill 306 along the back 308 of the housing 302 (see FIG. 7B) and/or a grill 324 along the top 326 of the housing 302 (see FIG. 7C)) may be pulled through the fan 26 by rotation of the impeller 28, with that air passing through the fan enclosure 30 and then through the heating section 10 before exiting the fireplace 300 via the air outlet (which may include a grill 310 on the front 312 of the housing 302). The electric fireplace 300 may include a plug 314 to provide electrical power to the fireplace, such as by connecting it to an ordinary electrical socket. The electric fireplace 300 may also include a control panel 316 on the front 312 of the housing 302, in order to control various aspects of the heating system, such as discussed above.

Figure 8:
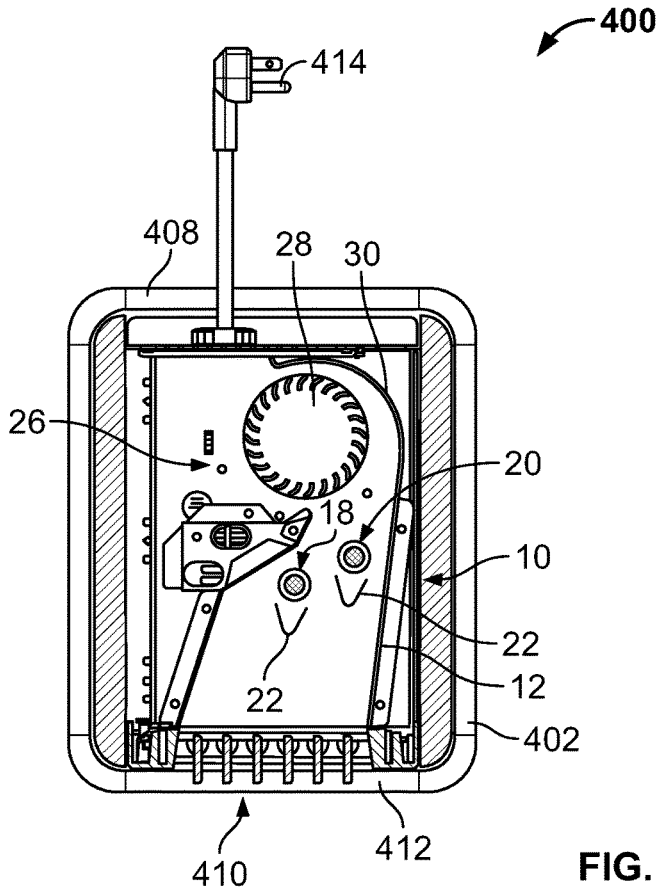
FIG. 8 is a cross-sectional top plan view of a space heater incorporating an embodiment of a heating system in accordance with the present invention.
Figure 9A:
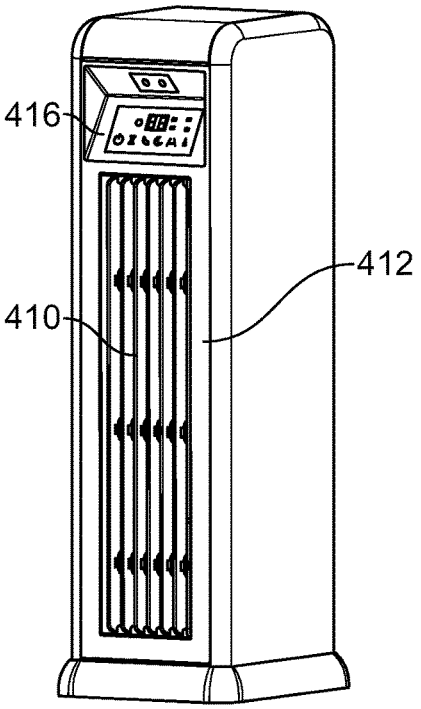
FIG. 9A is a front perspective view of the space heater of FIG. 8.
Figure 9B:
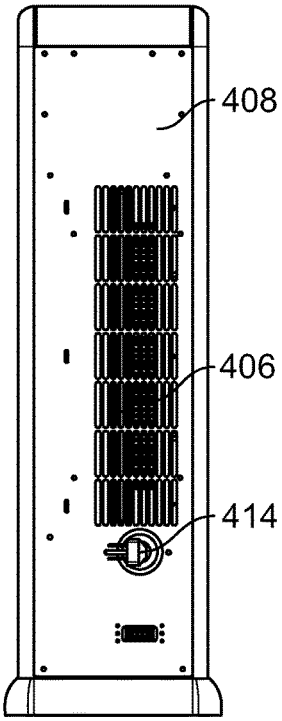
FIG. 9B is a rear elevation view of the space heater of FIG. 8.

Yet another embodiment of a heating device that may incorporate the heating system 1 is illustrated in FIGS. 8-9B. In that embodiment, the heating system 1 is incorporated into an electric space heater 400. The space heater 400 may include an outer housing 402, which may be in the shape of a vertical tower. The heating system 1 may be positioned within the housing 402 such that air from an air intake (which may include a grill 406 on the back 408 of the housing 402) may be pulled through the fan 26 by rotation of the impeller 28, with that air passing through the fan enclosure 30 and then through the heating section 10 before exiting the heater 400 via the air outlet (which may include a grill 410 on the front 412 of the housing 402). The heater 100 may include a plug 414 to provide electrical power to the heater, such as by connecting it to an ordinary electrical socket. The heater 400 may also include a control panel 416 on the front 412 of the housing 402, in order to control various aspects of the heating system, such as discussed above. As shown in FIG. 8, only one infrared heating element 18 and one halogen lamp 20 may be provided in the heating section 10. Moreover, each of those heating elements may include a respective baffle 22.

The heating elements discussed above, including the infrared heating elements 18 and the halogen lamps 20, may be provided in a variety of wattages, so as to provide the amount of heat desired to be provided by the unit. In accordance with some embodiments of the invention, preferable ranges of wattages for each heating element may be between about 400 watts and 1000 watts. Moreover, different wattages may be used in different heating devices, depending on the application. For example, the heating elements used in devices intended to function primarily as space heaters may be have a higher wattage (e.g., between about 700 and 800 watts for each heating element) than those used in devices also intended to have a decorative purpose, such as the electric fireplace embodiments (where the wattage of each heating element may be between about 450 and 550 watts).

Although the examples of the heating elements discussed above included infrared heating elements and halogen lamps, heating elements in accordance with the present invention are not limited to those two types. For example, other embodiments may include multiple heating elements, where at least one of those heating elements provides more instantaneous and directly-felt heat by a user, whereas at least one of the other heating elements provides distributed heat to the larger area surrounding the heating device. That way, the heating system including such different types of heating elements may beneficially provide a broad spectrum of heating as well as a fast heat-up time.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An electrical heating system comprising:

a duct defining a heating section, the heating section having an inlet, an outlet, and at least one baffle, at least one infrared heating element positioned within the heating section, wherein the at least one infrared heating element operatively produces primarily infrared energy operatively directed to heat the at least one baffle;

at least one halogen lamp positioned proximate to the outlet of the heating section to operatively emit heat to an area proximal the outlet, wherein the at least one halogen lamp is a different type of heating element than the at least one infrared heating element such that the at least one halogen lamp operatively produces heat at a faster rate than the infrared heating element, and wherein the at least one halogen lamp is positioned between the outlet and the at least one infrared heating element; and a fan positioned in communication with the duct, the fan adapted to move air through the heating section from the inlet to the outlet, wherein the at least one baffle is positioned proximate the at least one halogen lamp, the at least one baffle being positioned between the at least one halogen lamp and the outlet.

2. The electrical heating system of claim 1, wherein the at least one infrared heating element comprises a plurality of infrared heating elements, and wherein the at least one halogen lamp comprises a single halogen lamp.

3. The electrical heating system of claim 2, wherein the single halogen lamp is positioned closer to the outlet than the plurality of infrared heating elements.

4. The electrical heating system of claim 1, wherein the fan is a crossflow fan.

5. The electrical heating system of claim 1, wherein the infrared heating element includes a filament positioned within an unsealed glass envelope.

6. The electrical heating system of claim 1, wherein the halogen lamp includes a filament positioned within a sealed glass envelope, the sealed glass envelope also including a halogen gas therein.

7. The electrical heating system of claim 1, further comprising a housing, the housing surrounding the duct and including an air outlet adapted to permit heated air to pass therethrough.

8. The electrical heating system of claim 7, further comprising a firebox arranged within the housing, the firebox including at least one artificial log.

9. The electrical heating system of claim 8, wherein the log is visible from outside of the housing through at least one opening in the housing.

10. An electrical heating system comprising:

a housing including an air inlet, an air outlet adapted to permit heated air to pass therethrough, and at least one baffle;

at least one infrared heating element arranged within the housing so as to heat air passing through the air outlet and to heat the at least one baffle, wherein the wherein the at least one baffle is positioned between the air outlet and the at least one infrared heating element, and wherein the at least one infrared heating element operatively produces primarily infrared energy to heat the at least one baffle; and at least one halogen lamp arranged proximate the air outlet within the housing so as to heat air passing through the air outlet, wherein the at least one halogen lamp is a different type of heating element than the at least one infrared heating element, and operatively produces heat at a faster rate than the infrared heating element.

11. The electrical heating system of claim 10, further comprising a duct arranged within the housing to supply air to the air outlet, the at least one infrared heating element and the at least one halogen lamp being positioned within the duct.

12. The electrical heating system of claim 10, further comprising a fan arranged within the housing to drive air through the air outlet.

13. The electrical heating system of claim 10, wherein the at least one infrared heating element comprises a plurality of infrared heating elements, and wherein the at least one halogen lamp comprises a single halogen lamp.

14. The electrical heating system of claim 10, further comprising at least one baffle positioned proximate the at least one infrared heating element or the at least one halogen lamp.

15. The electrical heating system of claim 10, wherein the infrared heating element includes a filament positioned within an unsealed glass envelope.

16. The electrical heating system of claim 10, wherein the halogen lamp includes a filament positioned within a sealed glass envelope, the sealed glass envelope also including a halogen gas therein.

17. The electrical heating system of claim 10, further comprising a firebox arranged within the housing, the firebox including at least one artificial log.

18. The electrical heating system of claim 17, wherein the log is visible from outside of the housing through at least one opening in the housing.

* * * * *